United States Patent [19]

Muhlbach

[11] 4,363,148

[45] Dec. 14, 1982

[54] SHOE SOLE ATTACHING PRESS

[75] Inventor: Anton Muhlbach, Frankfurt am Main, Fed. Rep. of Germany

[73] Assignee: USM Corporation, Farmington, Conn.

[21] Appl. No.: 234,112

[22] Filed: Feb. 13, 1981

[30] Foreign Application Priority Data

Feb. 29, 1980 [DE] Fed. Rep. of Germany ..... 3007830

[51] Int. Cl.[3] ..... A43D 89/00

[52] U.S. Cl. ..... 12/33

[58] Field of Search ..... 12/33, 33.4, 33.7, 38

[56] References Cited

U.S. PATENT DOCUMENTS

| | | | |
|---|---|---|---|
| 2,968,054 | 1/1961 | Haumann et al. | 12/33 |
| 3,012,259 | 12/1961 | Marasco | 12/33 |
| 3,201,811 | 8/1965 | Marasco | 12/33 |

*Primary Examiner*—Patrick D. Lawson

*Attorney, Agent, or Firm*—Donald N. Halgren

[57] ABSTRACT

A shoe sole attaching press in which a pressure member is moved by a relatively small cylinder from a retracted location into engagement with a shoe whereupon an interlocking means locks a relatively large pressure applying cylinder to means for applying force to the pressure member.

7 Claims, 2 Drawing Figures

SHOE SOLE ATTACHING PRESS

FIELD OF THE INVENTION

The invention relates to a shoe sole attaching press in which a pressure applying member is moved by a small cylinder under low pressure between a retracted position and a shoe engaging position and a large cylinder then causes the member to apply a working force under higher pressure when in engaging position.

DESCRIPTION OF THE PRIOR ART

German Pat. No. 10 31 681 discloses a typical sole cementing press in which a shoe on a last is placed on an inflatable pad acting as a presser member for the attaching of a sole to a shoe. The pad is raised via an extending and retracting mechanism effecting movement in the vertical direction until the lasted shoe comes into contact with an abutment that includes two shoe engaging posts. On attaining this position, a latch engages a toothed rack on the extending means. The rack together with the latch serve therefore as locking means preventing further bodily movement on the pad away from the abutment. Thereupon follows the inflation of the pad such as with compressed air thus exerting the necessary attaching pressure onto the sole. By the locking of the extending means for the pad by the latch, the high pressure necessary for attaching the sole need not be supplied by the extending means, which has to travel varying distances according to the height of the shoe to be processed. The high sole attaching pressure is produced by the compressed air inflated into the pad exerting high pressure only a short distance.

Since the inflatable pads have always presented certain problems, attempts were made to make do without such a pad. For this purpose, cementing presses have been developed, with which the presser member is brought into contact with the shoe to be processed by means of hydraulic means, which coaxially in itself contains an additional piston, which on account of its large cross-sectional area produces the final pressure necessary for the sole-cementing attaching. Such hydraulic fittings are complicated and consequently expensive.

BRIEF SUMMARY OF THE INVENTION

Accordingly, it is an object of the invention to simplify the construction of cementing presses of the type described above. According to the invention, this is achieved in that locking means forms a link between the extending means and the additional pressure means, which upon becoming interlocked exerts a higher pressure onto the presser member than the extending means is capable of.

By this arrangement, the relatively small sized extending means serves merely to move the presser member from a retracted location to a location against the shoe to be processed, without it being necessary to apply the high bedding pressure for that purpose over a considerable distance. The high pressure is then produced by additional high pressure means via the locking means establishing a link between the extending means and the additional pressure means, so that on completion of the interlocking means becoming engaged with the extending means the high pressure exerted onto the interlocking means can bear fully onto the extending means and thereby onto the pressure member. The interlocking means can appropriately take the form of a rack portion assigned to the extending means and of a latch, through which acts the force of the pressure means. In this case, the force exerted by the pressure means is transferred through the latch to the rack portion and thus onto the extending means, which consequently exerts the high pressure produced by the pressure means onto the shoe to be processed.

In an alternate form, the interlocking means includes a driving cone assigned to but freely movable on the extending means and a coacting tapered clamping member responsive to the force of the pressure means. In this form of embodiment, the driving cone is clamped firmly on the extending means by the tapered clamping member under pressure from the pressure means. The extending means is thus exposed gradually to the pressure of the pressure means in its respectively attained end position.

The design of the extending means can take such a form, that on the one hand is arranged a piston of a piston-cylinder unit and on the other hand is arranged a pressure bar adjacent thereto, to which is assigned the interlocking means. In that case, the piston of the piston-cylinder unit takes care of extending the presser member up to the shoe to be processed, while the force of the pressure means is exerted onto the pressure bar via the interlocking means. In that case, the piston-cylinder unit need only be of a size capable of lowering the presser member onto the shoe in a practically force-free manner, while the pressure bar serves solely for the transmission of the high pressure, which is supplied by the pressure means. It is however also possible to combine the piston-cylinder unit strictly for the lowering of the pressure member together with the presser bar in such a way, that the piston-cylinder unit is contained in the pressure bar, which is then assigned to the interlocking means.

The mode of operation of the pressure means can be further advantageously intensified in that the interlocking means is arranged on a lever, on which is acting the force of the pressure means. In that case, the mechanical advantage of the lever can thus be made use of, in that the interlocking means is mounted appropriately in such a way, that it lies on the lever between its pivot point and the connection of the pressure means.

A particularly advantageous element suitable for supplying the high pressure is the so-called diaphragm cylinder, which is used especially in the motor industry for the application of brakes. Such a diaphragm cylinder can therefore advantageously be used as pressure means, whereby is to be taken additionally into account, that such diaphragm cylinders are as a rule pneumatically operated and that they are capable of producing particularly high thrust forces over short distances. Such diaphragm cylinders are readily available and are a particularly moderately-priced structural element which can be used with little or no modification.

DESCRIPTION OF THE PREFERRED EMBODIMENTS

Figure 1:
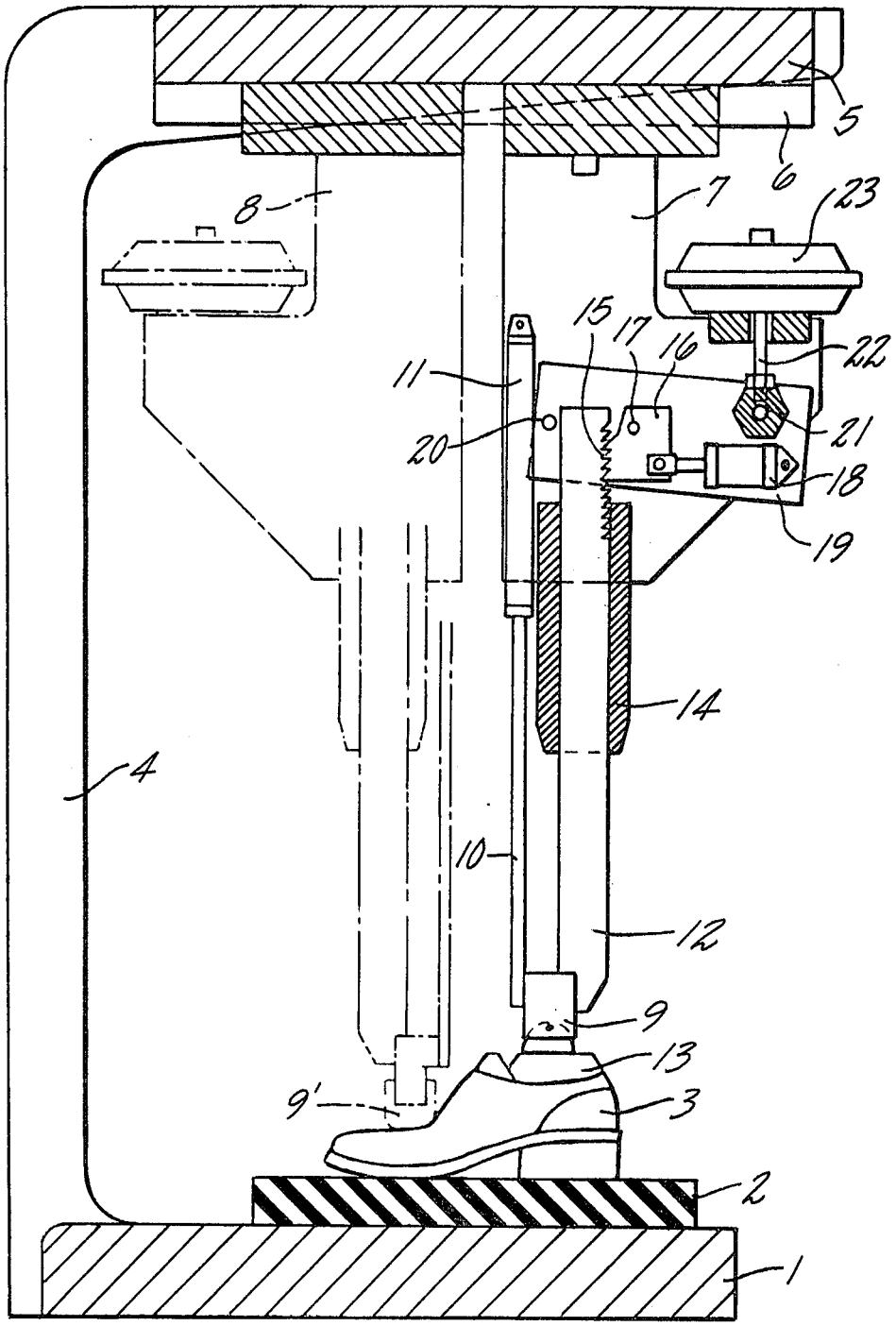
FIG. 1 is a schematic view of a shoe sole press partly in section showing a unit for extending a pressure member and a separate pressure bar, to which force is supplied by a pressure means via a rack and a latch.

The press shown in FIG. 1 comprises a base 1 carrying a rubber pad 2 serving as a yieldable support for a shoe 3 to be processed. From the base 1 the stand 4 projects upwardly and carries a cross-beam 5 to which is affixed a rail 6. Two carrier sections 7 and 8 may be positioned in a horizontal direction along the rail and mount substantially similar mirror-inverted arrangements for applying pressure simultaneously to the heel seat and the forepart of a shoe supported on the pad 2. For reasons of simplification of the description only the mechanism mounted on the carrier section 7 is illustrated in full lines while that mounted on the carrier 8 is indicated only in dashed lines.

From the presser member 9 adapted to engage the heel end portion of the last 13 projects upwardly a piston rod 10 extending down from a cylinder 11 and a pressure bar 12. Piston rod 10 and pressure bar 12 thus form extending means for engaging the presser member 9 with the shoe last. At the start of the operating sequence, the presser member 9 is lowered from a retracted position (not shown) by means of the cylinder 11 until the presser member 9 contacts the top of the last 13. Practically no force need to be applied for this, since it purely concerns an extending mechanism not designated to apply a significant pressure to the last 13. When the member 9 has reached the position shown in FIG. 1, a high pressure is additionally applied to the presser member 9 via the pressure bar 12, which slides in a guide 14 for the purpose of precise alignment only, and is provided at its end opposite the presser member 9 with a rack portion 15 engageable by a latch 16. The latch 16 is pivoted on a pin 17 by means of a piston-cylinder unit 18, so that it is brought either into or out of engagement with the rack portion 15. The rack portion 15 and the latch 16 form the aforementioned interlocking means. The latch 16 together with the cylinder 18 is mounted on the lever 19, which is pivoted at 20 on the carrier section 7. The pin 17 is affixed to the lever 19, so that the latch 16 moves with any swinging movement of the lever 19. The lever opposite the pivot 20 is connected at 21 to a plunger 22, which projects from a pneumatically-operated diaphragm cylinder 23 also mounted on the section 7. When the diaphragm cylinder 23 is pressurized, the plunger 22 moves down causing the lever 19 to swing down around its pivot 20. The latch 16 through its engagement with the rack portion 15 urges the pressur bar 12 down, so that the force exerted by the diaphragm cylinder 23 acts on the pressure member 9 with pressure increased by the mechanical advantage ratio of the lever 19. The diaphragm cylinder 23 represents a commercial structural element, that is able to apply considerable force to its plunger 22, so that in the case of the illustrated press considerable pressures can be exerted via the pressure bar 12 and the presser member 9 to the shoe 3. After a sole attaching pressing cycle is completed, the latch 16 is withdrawn from its engagement with the rack portion 15, so that the presser member 9 can be retracted from the shoe 3 by means of the cylinder 11 without movement of the plunger 22 of the cylinder 23. At the same time the structural elements of the press associated with the carrier section 8 operate in the same way as described above.

The above press action can be controlled in a known way so that the cylinder 11 is first operated pneumatically until the presser member 9 contacts the last whereupon a somewhat higher pressure builds up in the supply line to operate a pressure-sensitive valve (not shown), that in turn supplies air pressure to the cylinder 18. After the latch 16 engages the rack portion 15, the pressure continues to build up further, whereupon a valve (not shown) set to operate at a higher pressure, actuates for supplying pressure to the diaphragm cylinder 23, which then exerts the particularly high force required for pressing the shoe. Only one control needs to be provided for both sections of the illustrated press, since the pressure operating the aforementioned valves can build up only when both presser members 9 and 9' respectively have engaged the shoe. The same applies correspondingly for the operation of the latch 16 and its counterpart on the side of the carrier section 8.

Figure 2:
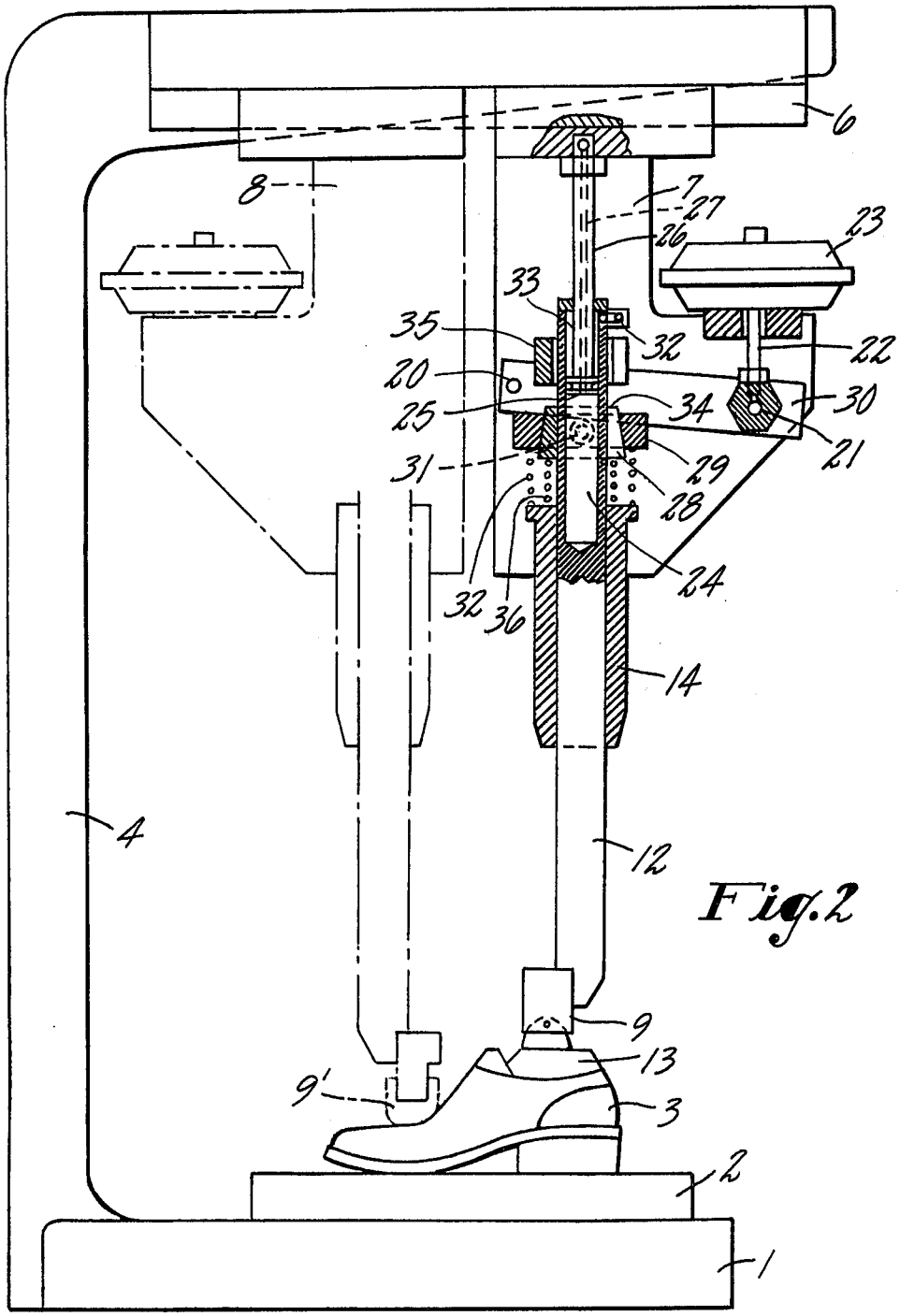
FIG. 2 is a view similar to FIG. 1 showing an alternate form of the invention in which a driving cone and a tapered clamping member are provided in place of the rack and the latch.

The alternate form of press illustrated in FIG. 2 works on the same principle as the press according to FIG. 1. Consequently, the same structural elements are provided with the same reference numbers as in FIG. 1. Different on the press according to FIG. 2 is the mechanism for initially extending the presser member 9 into engagement with the shoe as well as the design of the interlocking means. On the press according to FIG. 2 the presser member 9 is extended from a retracted position (not shown) by means of a cylinder 24, into which extends a rigidly mounted piston 25. The piston 25 is at the end of a piston 26, which is suspended from the rail 6. The piston rod 26 is provided with an axial bore 27, through which compressed air can be supplied to the cylinder 24. In this case, the cylinder 24 moves relative to the piston 25 in a direction toward the shoe 3, whereby the pressure bar 12, in which the cylinder 24 is formed is taken along with it. This mechanism for moving the pressure bar 12 and the pressure member 9 corresponds as to its function of the piston-cylinder unit 11 according to the press in FIG. 1.

When the presser member 9 has reached the position shown in FIG. 2, a high pressure is additionally applied onto the presser member 9 via the pressure bar 12. This is brought about in the following way: A driving cone 28 having at least one axial slot fits within a clamping member 29 having a complementary internal taper. A spring 36 between the lower end of the driving cone 28 and the upper end of the guide 14 initially holds the cone with its upper face 34 against a fixed stop 35. At this time, the pressure bar is freely slidable within the cone during its downward movement to engage the presser member with the shoe last 13 as above described. Also at this time a spring 37 between the guide 14 and the lower end of the clamp member 29 holds the clamp member in an uppermost position. The clamp member 29 is provided with two trunnions 31 (only one shown in FIG. 2) which are engaged by a lever 30, which corresponds to the lever 19 of the cementing press according to FIG. 1. The lever acts in the same way as in the layout according to FIG. 1 to apply the higher working pressure to the presser member 9 upon pressurizing the pneumatically-operated diaphragm cylinder 23. The lever 30 through the two trunnions 31, moves the tapered clamping member 29 down upon the lever 30 being moved down against the action of springs 37 when the diaphragm cylinder 23 is pressurized. The driving cone 28 is supported by the spring 36 while the clamping member 29 is moved down so the driving cone is squeezed through the complementary taper in the clamping member and clamped on the pressure bar 12. The force applied by the diaphragm cylinder 23 is then intensified and transmitted through the lever 30, clamp member 29, cone 28, pressure bar 12 and presser member 9 to the shoe 3.

Upon completion of the pressing operation on the shoe compressed air is passed into the upper chamber 33 of the cylinder 24 via an inlet 32. The pressure bar 12 and its presser member 9 are retracted upwardly away from the shoe 3 while the air is exhausted from the bore 27. Also, the pressure in the diaphragm cylinder 23 is exhausted, so that the lever 30 is swung upwardly under the action of a spring contained in the diaphragm cylinder 23. When the pressure bar 12 is moved upwardly, the face 34 of the driving cone 28 strikes the stop 35 while clamping member 29 continues to move up via the spring 37 as permitted by the upward movement of the lever 30 whereby the driving cone 28 is unclamped from the pressure bar 12.

Having thus described my invention, what I claim as new and desire to secure by Letters Patent of the United States is:

1. A press for attaching shoe components having an abutment supporting the shoe components concerned and a presser member movable by extending means in the direction toward the abutment into engagement with the respective shoe component, whereby the extending means operates in conjunction with interlocking means, which upon the presser member reaching the shoe component becomes locked to the extending means characterized in that the interlocking means forms the link between the extending means and additional pressure means which upon becoming interlocked exerts a higher pressure onto the presser member than the extending means.

2. A press according to claim 1 in which the interlocking means consists of a rack portion secured to the extending means and of a latch through which is exerted the pressure of the pressure means.

3. A press according to claim 1 in which the interlocking means consists of a driving cone slidably mounted on the extending means and a complementary tapered clamping member adapted to clamp the cone on the extending means and through which is exerted the pressure of the pressure means.

4. A press according to one of the claims 1 to 3, in which the extending means consists of a piston rod of a relatively small piston-cylinder unit and of a pressure bar arranged adjacent thereto, to which is assigned the locking means.

5. A press according to claim 3 in which the extending means consists of the piston rod of a piston-cylinder unit formed coaxially in the pressure bar to which is assigned the interlocking driving cone and clamping means.

6. A press according to one of the claims 1 to 5 in which the interlocking means is associated with a lever through which acts the pressure means.

7. A press according to one of the claims 1 to 6, thereby characterized, that a diaphragm-cylinder is employed as pressure means.

* * * * *